US008305418B2

(12) United States Patent
Nagamine

(10) Patent No.: US 8,305,418 B2
(45) Date of Patent: Nov. 6, 2012

(54) EXPOSURE DEVICE AND IMAGE FORMING APPARATUS HAVING A FORCING PORTION

(75) Inventor: Masamitsu Nagamine, Tokyo (JP)

(73) Assignee: Oki Data Corporation, Tokyo (JP)

( * ) Notice: Subject to any disclaimer, the term of this patent is extended or adjusted under 35 U.S.C. 154(b) by 193 days.

(21) Appl. No.: 12/662,324

(22) Filed: Apr. 12, 2010

(65) Prior Publication Data

US 2010/0195079 A1 Aug. 5, 2010

Related U.S. Application Data

(62) Division of application No. 12/230,240, filed on Aug. 26, 2008, now Pat. No. 7,760,224.

(30) Foreign Application Priority Data

Sep. 20, 2007 (JP) ..... 2007-244094

(51) Int. Cl.
*B41J 2/45* (2006.01)

(52) U.S. Cl. ..... 347/238

(58) Field of Classification Search ..... 347/230, 347/241, 242, 244, 245, 256–258, 238
See application file for complete search history.

(56) References Cited

U.S. PATENT DOCUMENTS 6,025,863 A 2/2000 Nakajima et al.
6,809,752 B2 * 10/2004 Nagamine ..... 347/238

FOREIGN PATENT DOCUMENTS

| | | | |
|---|---|---|---|
| JP | 4-138262 | | 5/1992 |
| JP | 06-198957 | A | 7/1994 |
| JP | 7-115511 | | 5/1995 |
| JP | 2002-144624 | A | 5/2002 |
| JP | 2003-285470 | A | 10/2003 |
| JP | 2005-074677 | | 3/2005 |
| JP | 2005-153362 | A | 6/2005 |

* cited by examiner

*Primary Examiner* — Hai C Pham
(74) *Attorney, Agent, or Firm* — Rabin & Berdo, P.C.

(57) ABSTRACT

An exposure device includes a substrate on which a light emitting element array is provided, a focusing lens that focuses light emitted by the light emitting element array, a supporting member that supports the substrate and the focusing lens. The supporting member has a contact surface. A base is provided for forcing the substrate against the contact surface of the supporting member. The base has a first engaging portion that engages a second engaging portion formed on an inner wall of the supporting member. The base is mounted to the supporting member by the engagement of the first engaging portion and the second engaging portion.

21 Claims, 11 Drawing Sheets

EXPOSURE DEVICE AND IMAGE FORMING APPARATUS HAVING A FORCING PORTION

BACKGROUND OF THE INVENTION

The present invention relates to an exposure device and an image forming apparatus.

A conventional image forming apparatus such as a printer, a copier, a facsimile machine, a complex machine or the like is configured to form an image as follows. A surface of a photosensitive drum is uniformly charged by a charging roller. The surface of the photosensitive drum is exposed by an LED (Light Emitting Diode) head as an exposure device so that a latent image is formed on the surface of the photosensitive drum. Then, a toner layer formed on a developing roller adheres to the latent image, and a toner image formed. The toner image is transferred to a recording medium by a transfer roller. The toner remaining on the surface of the photosensitive drum after the transferring is removed by a cleaning device.

A general LED head includes an LED array chip that emits light and a rod lens array that focuses the light on the surface of the photosensitive drum. The LED array chip includes LED chips arranged on an elongated substrate.

On the assembling of the LED head, the substrate (with the LED chips) is mounted to a lens array holder (as a supporting member) holding the rod lens array. More specifically, the substrate is inserted into the lens array holder so that both ends of the substrate in the widthwise direction are placed on contact surfaces formed inside the lens array holder. Then, a base made of metal is placed on the substrate, and a plurality of clamps are attached to the lens array holder so as to force the substrate against the contact surfaces via the base. The clamps protrude outwardly from the lens array holder (see, Japanese Laid-open Patent Publication No. H7-115511).

SUMMARY OF THE INVENTION

The present invention is intended to provide an exposure device and an image forming apparatus capable of reducing size and capable of simplifying an operation for mounting a substrate to a supporting member.

The present invention provides an exposure device including a substrate on which a light emitting element array is provided, a focusing lens that focuses light emitted by the light emitting element array, and a supporting member that supports the substrate and the focusing lens. The supporting member has a contact surface. The exposure device further includes a base for forcing the substrate against the contact surface of the supporting member. The base has a first engaging portion that engages a second engaging portion formed on an inner wall of the supporting member. The base is mounted to the supporting member by engagement of the first engaging portion and the second engaging portion.

With such an arrangement, the base can be mounted to the supporting member without using clamps, and the size of the exposure device can be reduced. Further, the substrate can be forced against the contact surface by the base, and the operation for mounting the substrate to the supporting member can be simplified.

The present invention also provides an exposure device including a substrate on which a light emitting element array is provided. The substrate has a first surface and a second surface opposite to the first surface. The exposure device further includes a focusing lens that focuses light emitted by the light emitting element array. The focusing lens faces the first surface of the substrate. The exposure device further includes a supporting member including a lens-supporting portion that supports the focusing lens and a substrate-supporting portion that supports the substrate at a predetermined distance from the focusing lens. The substrate supporting portion is disposed between the substrate and the focusing lens. A forcing member forces the substrate against the substrate-supporting portion from the second surface side of the substrate. The forcing member has a first surface facing the substrate and a second surface opposite to the first surface. The supporting member has an engaging portion that engages the forcing member from the second surface side of the forcing member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to the attached drawings. A printer as an example of an image forming apparatus will be described.

First Embodiment

Figure 2:
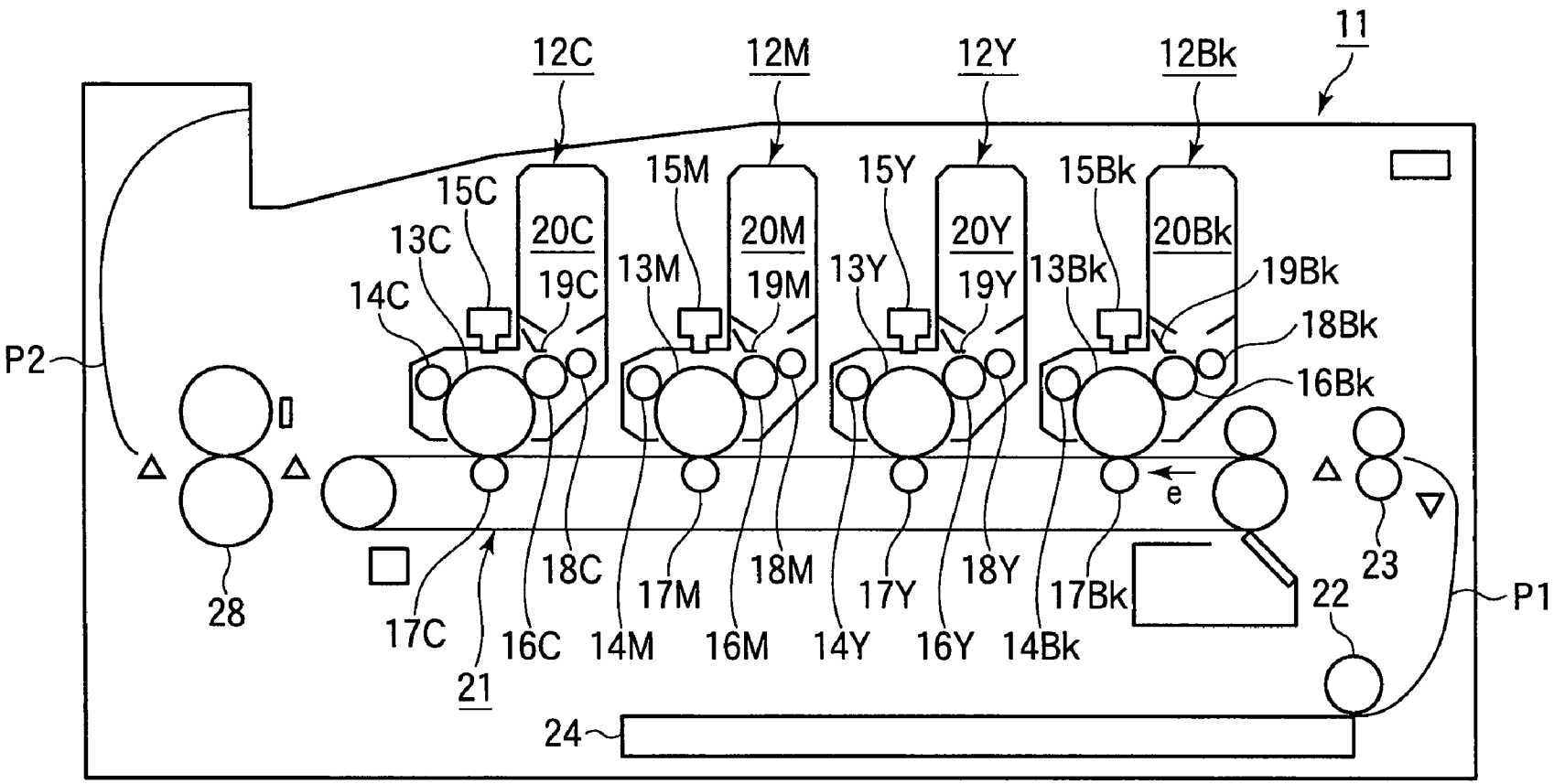
FIG. 2 is a schematic view showing a printer according to the first embodiment of the present invention.

FIG. 2 is a schematic view showing a printer according to the first embodiment of the present invention.

As shown in FIG. 2, a printer 11 of this embodiment includes four independent image forming units 12Bk, 12Y, 12M and 12C arranged along a conveying path of a sheet (for example, a paper) as a recording medium from an upstream side (i.e., an insertion side) to a downstream side (i.e., an ejection side). The image forming units 12Bk, 12Y, 12M and 12C respectively form images of black, yellow, magenta and cyan. OHP sheets, envelopes, copy sheets, specialized sheets or the like can be used as recording medium, as wall as papers.

The image forming units 12Bk, 12Y, 12M and 12C respectively include photosensitive drums 13Bk, 13Y, 13M and 13C as image bearing bodies, charging rollers 14Bk, 14Y, 14M and 14C that uniformly charge surfaces of the photosensitive drums 13Bk, 13Y, 13M and 13C, developing rollers 16Bk, 16Y, 16M and 16C (i.e., developer bearing bodies) that develop latent images formed on the surfaces of the photosensitive drums 13Bk, 13Y, 13M and 13C with not-shown toners (i.e., developers) to form visible toner images of respective colors, and the like. Toner supplying rollers 18Bk, 18Y, 18M and 18C (i.e., developer supplying members) are disposed so as to be pressed against the developing rollers 16Bk, 16Y, 16M and 16C. The toner supplying rollers 18Bk, 18Y, 18M and 18C supply the toner from toner cartridges 20Bk, 20Y, 20M and 20C to the developing rollers 16Bk, 16Y, 16M and 16C. Developing blades 19Bk, 19Y, 19M and 19C are disposed so as to be pressed against the developing rollers 16Bk, 16Y, 16M and 16C. The developing blades 19Bk, 19Y, 19M and 19C form thin layers of the toner supplied by the toner supplying rollers 18Bk, 18Y, 18C and 18M on the surfaces of the developing rollers 16Bk, 16Y, 16M and 16C.

LED heads 15Bk, 15Y, 15M and 15C (i.e., exposure devices) are disposed above the photosensitive drums 13Bk, 13Y, 13M and 13C of the image forming units 12Bk, 12Y, 12M and 12C. The LED heads 15Bk, 15Y, 15M and 15C face the photosensitive drums 13Bk, 13Y, 13M and 13C, and expose the surfaces of the photosensitive drums 13Bk, 13Y, 13M and 13C to form latent images thereon based on image data of the respective colors.

A transfer unit is disposed below the photosensitive drums 13Bk, 13Y, 13M and 13C of the image forming units 12Bk, 12Y, 12M and 12C. The transfer unit includes a conveying belt 21 (i.e., a conveying member) capable of moving in a direction shown by an arrow "e" in FIG. 2, and transfer rollers 17Bk, 17Y, 17M and 17C (i.e., transfer members) disposed so as to face the photosensitive drums 13Bk, 13Y, 13M and 13C via the conveying belt 21. The transfer rollers 17Bk, 17Y, 17M and 17C cause the sheet to be charged to a polarity opposite to the toner so that the toner of the respective colors are transferred to the sheet.

A sheet feeding mechanism is provided on a lower part of the printer 11, for feeding the sheet to the conveying path. The sheet feeding mechanism includes a hopping roller 22, a registration roller pair 23, a sheet storing cassette 24 (i.e., a medium storing portion) and the like. The sheet stored in the sheet storing cassette 24 is individually picked up by the hopping roller 22 and is fed along a feeding path P1 to the registration roller pair 23. The sheet is fed by the registration roller pair to the conveying belt 21. The sheet is further conveyed by the movement of the conveying belt 21. When the sheet passes the image forming portions 12Bk, 12Y, 12M and 12C, the toner images of the respective colors are transferred to the sheet by the transfer rollers 17Bk, 17Y, 17M and 17C, and the color toner image is formed. The sheet on which the color toner image is formed is further conveyed to a fixing unit 28. The fixing unit 28 fixes the color toner image to the sheet. The sheet with the color toner image being fixed is further conveyed by an ejection roller pair (not shown) along an ejection path P2, and is ejected outside the printer 11.

Next, relationships between the photosensitive drums 13Bk, 13Y, 13M and 13C and the LED heads 15Bk, 15Y, 15M and 15C will be described. The relationships between the photosensitive drums 13Bk, 13Y, 13M and 13C of the image forming units 12Bk, 12Y, 12M and 12C and the respective LED heads 15Bk, 15Y, 15M and 15C are the same as each other, and therefore the relationship between the photosensitive drum 13Bk and the LED head 15Bk will be described.

Figure 1:
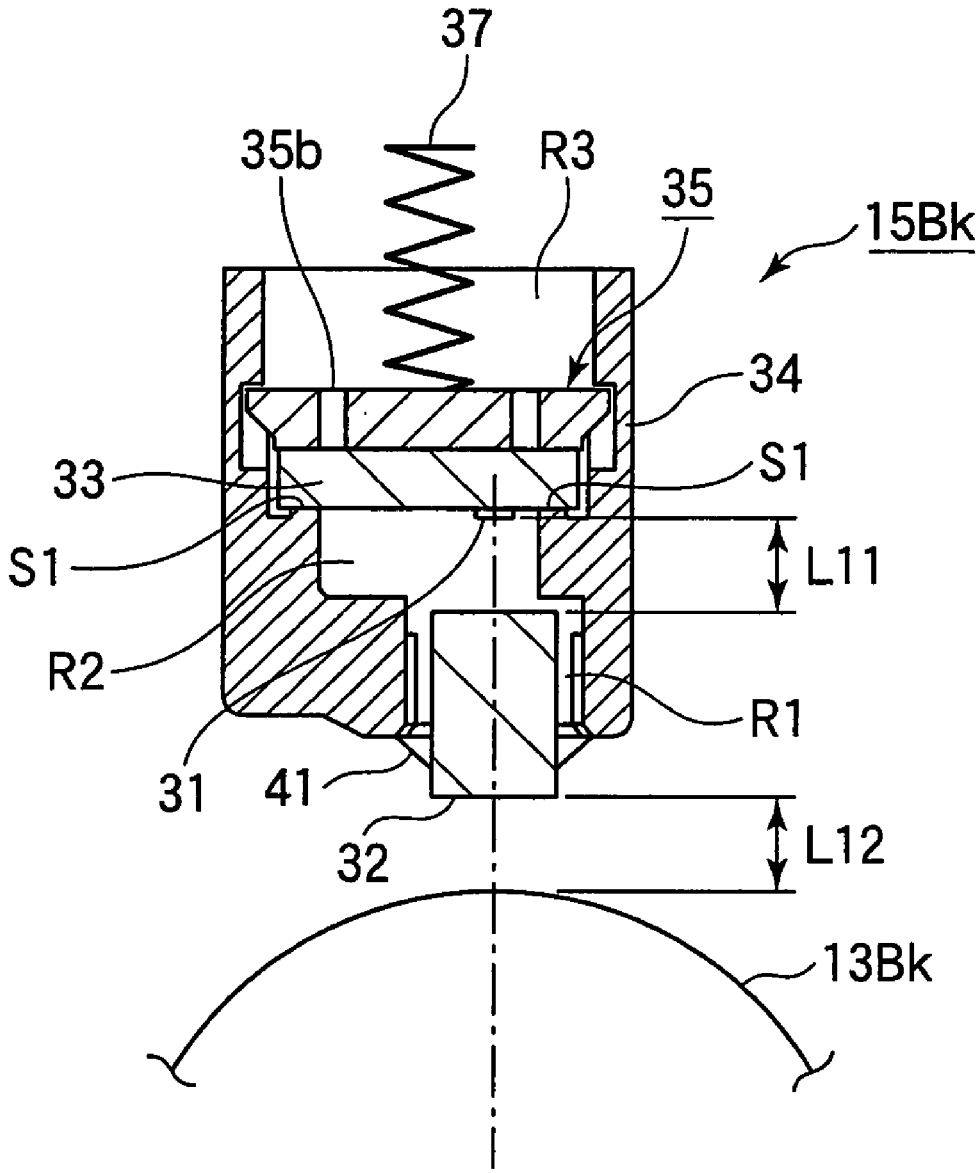
FIG. 1 is a cross sectional view showing an LED head according to the first embodiment of the present invention.
Figure 3:
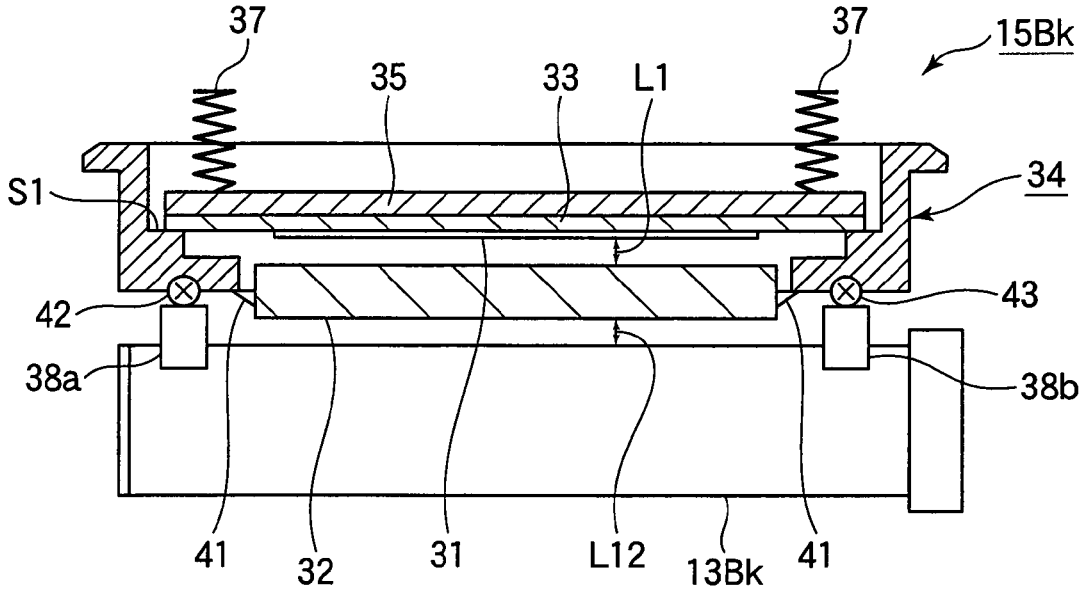
FIG. 3 is a longitudinal sectional view showing the LED head according to the first embodiment of the present invention.

FIG. 1 shows a cross sectional view showing the LED head according to the first embodiment of the present invention. FIG. 3 is a longitudinal sectional view showing the LED head according to the first embodiment of the present invention.

In FIG. 1, the LED head 15Bk is disposed so as to face the photosensitive drum 13Bk. The LED head 15Bk includes an LED array chip 31 (i.e., light emitting element array) including a plurality of LEDs (i.e., light emitting elements). The LED head 15Bk further includes a rod lens array 32 disposed between the LED array chip 31 and the photosensitive drum 13BK. The rod lens array 32 includes focusing lenses each of which has a convergence, and focuses the light emitted by each LED of the LED array chip 31. The LED head 15Bk further includes a substrate 33 on which the LED array chip 31 and a not-shown driver IC for driving the LED array chip 31 are provided. The LED head 15Bk further includes a lens array holder 34 (i.e., a supporting member) that supports the rod lens array 32 and the substrate 33. The lens array holder 34 is composed of a die-cast product formed by pouring aluminum material into a die.

The lens array holder 34 has an internal space that penetrates from the bottom to the top of the lens array holder 34. The internal space includes a first area R1 in which the rod lens array 32 is held, a second area R2 disposed above the first area R1 so as to be communicated with the first area R1, and a third area R3 disposed above the second area R2 so as to be communicated with the second area R2. The third area R3 has a width wider than the second area R2. Two step portions are formed on inner walls of the second area R2. Contact surfaces S1 are defined on the upper surfaces of the step portions.

The rod lens array 32 is disposed in the first area R1 and is fixed to the lens array holder 34. After the rod lens array 32 is fixed to the lens array holder 34, a gap between the rod lens array 32 and the lens array holder 34 is sealed by a silicon agent 41 for preventing entry of light or foreign material.

A base 35 (i.e., a forcing member) is provided in the lens array holder 34 for forcing the substrate 33 against the contact surfaces S1 of the lens array holder 34. The base 35 is formed of a material having a resiliency and flexibility, for example, a thermoplastic resin. To be more specific, the base 35 is composed of a general-purpose engineering plastic such as polyamide reinforced with glass fibers. With this, it becomes possible to enhance heat resistivity, heat deflection temperature properties or the like of the base 35, and to maintain stable resilient force for a long time.

Here, a distance L11 represents a distance between a surface of the LED array chip 31 and an end surface (i.e., an incident end surface) of the rod lens array 32 on which light is incident, i.e., a distance between the LED array chip 31 and the rod lens array 32. A distance L12 represents a distance between a surface (i.e., an emitting end surface) of the rod lens array 32 from which light is emitted and the surface of the photosensitive drum 13Bk, i.e., a distance between the rod lens array 32 and the photosensitive drum 13Bk. In order to correctly focus the light on the surface of the photosensitive drum 13BK, it is necessary to adjust the distance L12 to satisfy the following relationship:

$$L11=L12$$

For this purpose, eccentric cam mechanisms 42 and 43 (i.e., an adjusting mechanism) are provided in the vicinities of both ends of the lens array holder 34 in the longitudinal direction thereof as shown in FIG. 3. The eccentric cam mechanisms 42 and 43 respectively contact spacers 38*a* and 38*b* disposed on the surface of the photosensitive drum 13Bk.

Coil springs 37 are provided on both ends of the base 35. The coil springs 37 forces the LED head 15Bk in the direction toward the photosensitive drum 13Bk so that the eccentric cam mechanisms 42 and 43 contact the surfaces of the spacers 38*a* and 38*b* to thereby keep constant the distance L12. In this regard, the eccentric cam mechanisms 42 and 43 are configured to adjust the position of the lens array holder 34 with respect to the spacers 38*a* and 38*b* by rotating main bodies of the eccentric cam mechanisms 42 and 43.

Figure 4:
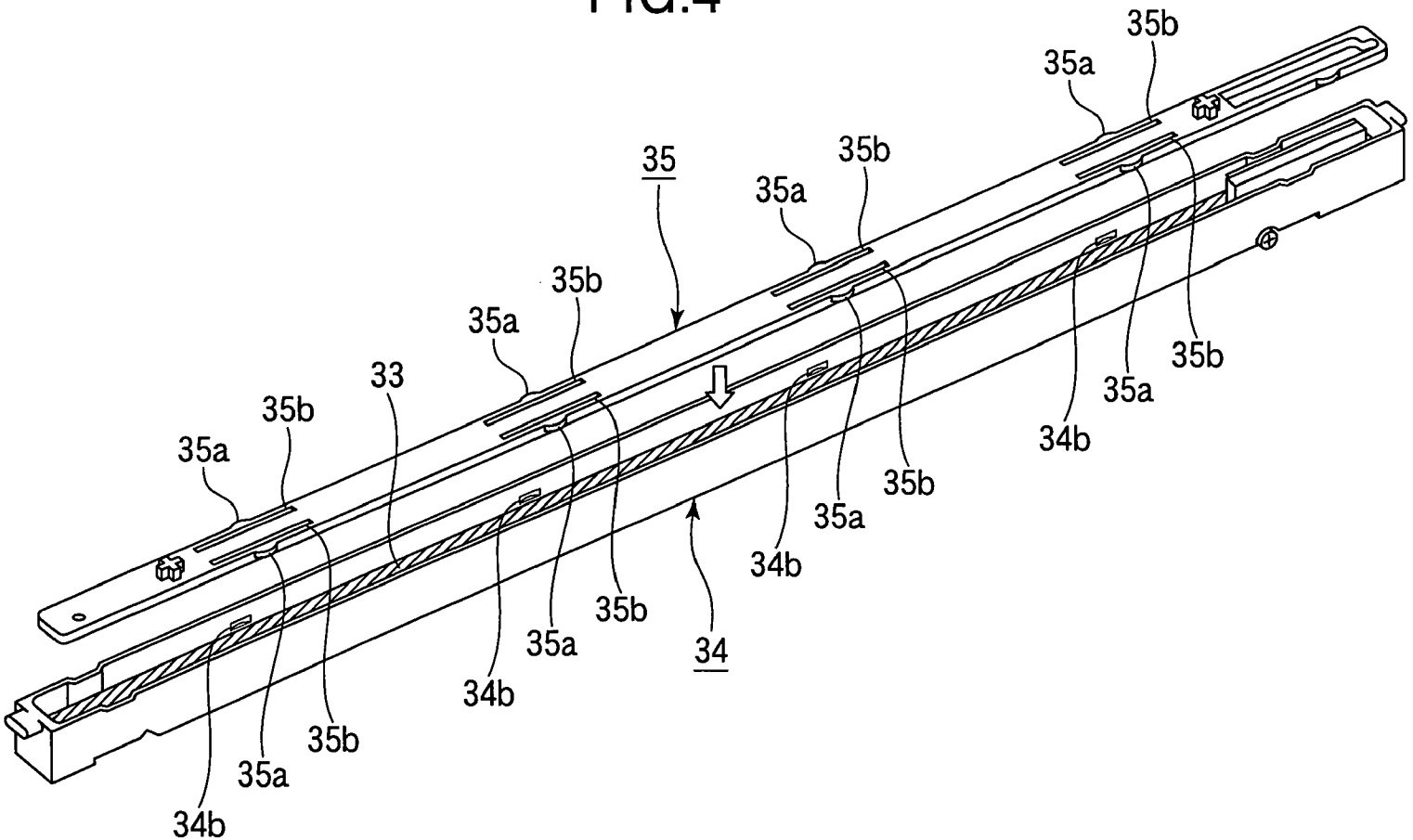
FIG. 4 is an exploded perspective view showing the LED head according to the first embodiment of the present invention.
Figure 5:
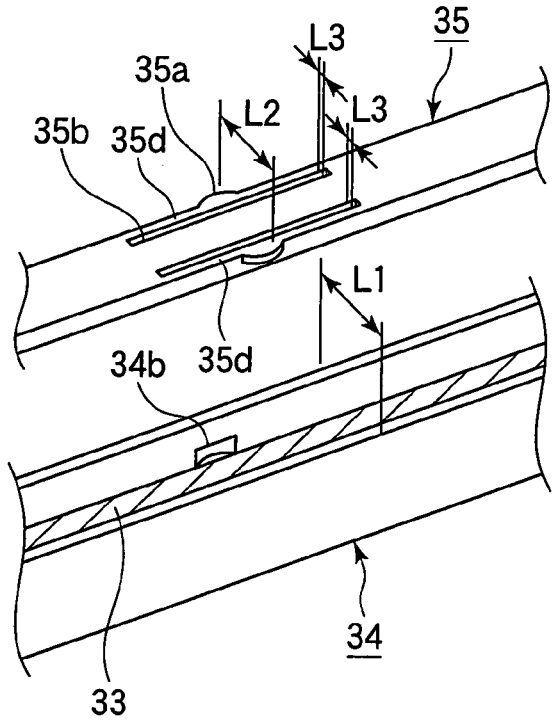
FIG. 5 is an exploded perspective view showing part of the LED head according to the first embodiment of the present invention.
Figure 6:
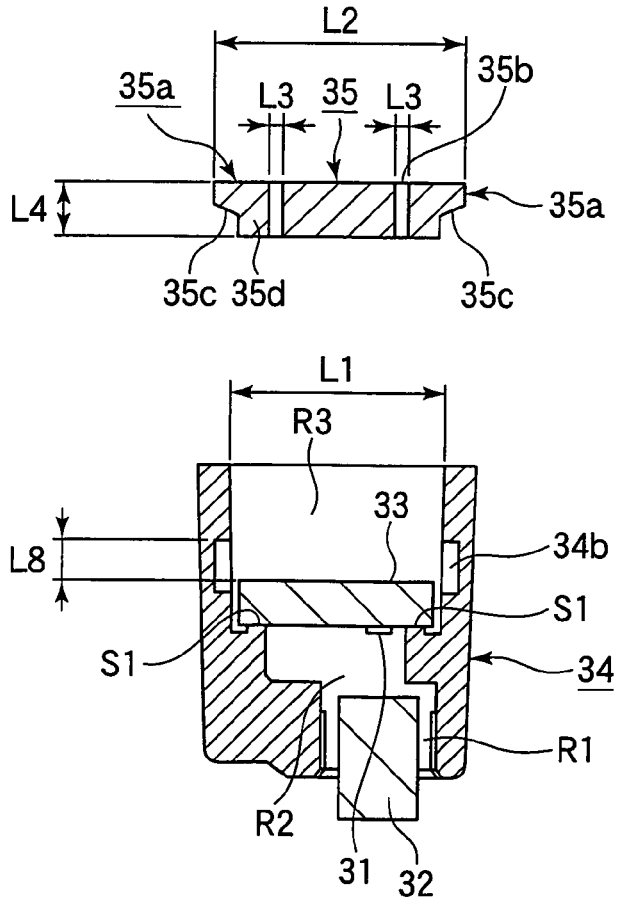
FIG. 6 is an exploded sectional view showing the LED head according to the first embodiment of the present invention.
Figure 7:
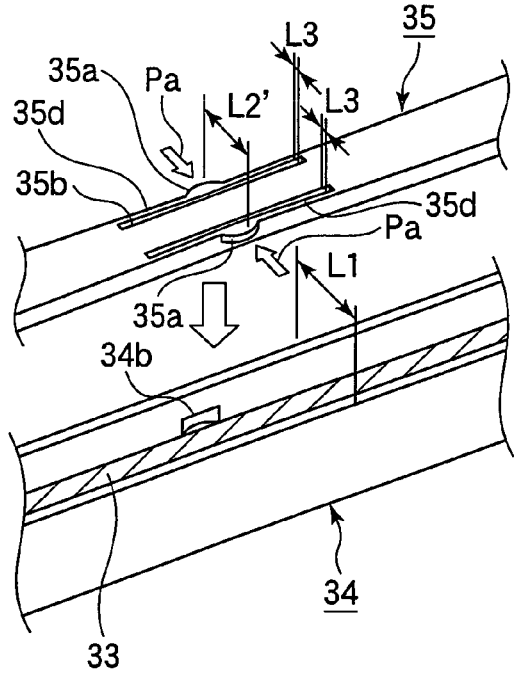
FIG. 7 is a perspective view showing a mounting operation of a base according to the first embodiment of the present invention.
Figure 8:
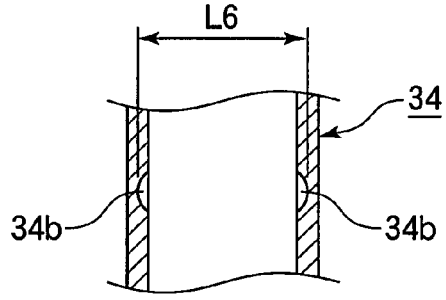
FIG. 8 is a horizontal sectional view showing part of a lens array holder according to the first embodiment of the present invention.

FIG. 4 is an exploded perspective view showing the LED head according to the first embodiment of the present invention. FIG. 5 is an exploded perspective view showing part of the LED head according to the first embodiment of the present invention. FIG. 6 is an exploded sectional view showing the LED head according to the first embodiment of the present invention. FIG. 7 is a perspective view showing a mounting operation of the base according to the first embodiment of the present invention. FIG. 8 is a horizontal sectional view showing part of a lens array holder according to the first embodiment of the present invention.

As shown in FIG. 4, protrusions 35*a* (i.e., first engaging portions) are formed on both longer edges of the base 35 (i.e., both ends of the base 35 in the widthwise direction thereof), and are disposed on a plurality of positions along the longitudinal direction of the base 35. Each protrusion 35*a* has a predetermined shape, and more specifically has an arc-shaped outer surface in this embodiment. The protrusions 35 protrude outwardly from both longer edges of the base 35. The protrusions 35*a* have chamfered portions 35*c* (i.e., guide portions) at the lower sides thereof as shown in FIG. 6. Further, slits 35*b* are on the base 35 and are respectively disposed on inner sides with respect to the protrusions 35*a* in the widthwise direction of the base 35. The slits 35*b* have predetermined lengths so as to extend on both sides of the protrusion 35*a* in the longitudinal direction of the base 35. A narrow bridge portion 35*d* (i.e., a forcing portion, and a deflectable portion) is formed between each slit 35*b* and the longer edge of the base 35. The bridge portions 35*d* have predetermined lengths so as to extend on both sides of the protrusion 35*a* in the longitudinal direction of the base 35. When forces are exerted on the protrusion 35*a* from both sides in the directions shown by arrows Pa in FIG. 7, the bridge portions 35*d* are deflected inwardly in the widthwise direction of the base 35, and cause the widths L3 of the slits 35*b* to be reduced so that both inner walls of each slit 35*b* contact each other.

As shown in FIG. 6, the distance L2 between tips of protrusions 35*a* opposing each other in the widthwise direction of the base 35 is set to be larger than the distance L1 between the inner walls of the lens array holder 34 as follows:

$$L2>L1.$$

Further, as shown in FIG. 7, the distance L2' between the tips of the protrusions 35*a* (opposing each other in the widthwise direction of the base 35) when the bridge portions 35*d* are deflected inwardly by predetermined amount is set to be slightly smaller than the above described distance L1.

In order to mount the base 35 to the lens array holder 34, grooves 34*b* (i.e., second engaging portions) are formed on the inner walls of the lens array holder 34. The grooves 34*b* are disposed on positions corresponding to the respective positions of the protrusions 35*a* of the base 35. Each groove 34*b* has a shape corresponding to the protrusion 35*a*, more specifically has an arc-shaped inner surface in this embodiment. The grooves 34*b* are formed to be slightly larger than the protrusions 34*a*. The distance L6 (FIG. 8) between bottoms of the grooves 34*b* opposing each other in the widthwise direction of the base 35 is larger than the above described distance L2 (FIG. 6) as follows:

$$L6>L2.$$

In this regard, the contact surfaces S1 are formed below the grooves 34*b* as shown in FIG. 6. When the substrate 33 is placed on the contact surface S1, an upper surface of the substrate 33 is at a higher position than the lower ends of the grooves 34. In a state where the substrate 33 is placed on the contact surfaces S1, a distance L8 (FIG. 6) from the upper surface of the substrate 33 to the upper ends of the grooves 34*b* is slightly larger than a thickness L4 of the base 35 as follows:

$$L4<L8.$$

Next, the mounting operation of the base 35 will be described.

Figure 9:
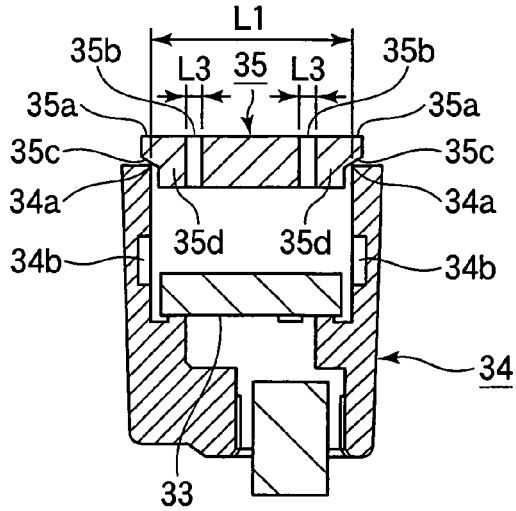
FIG. 9 is a first view for illustrating a mounting process of the base according to the first embodiment of the present invention.
Figure 10:
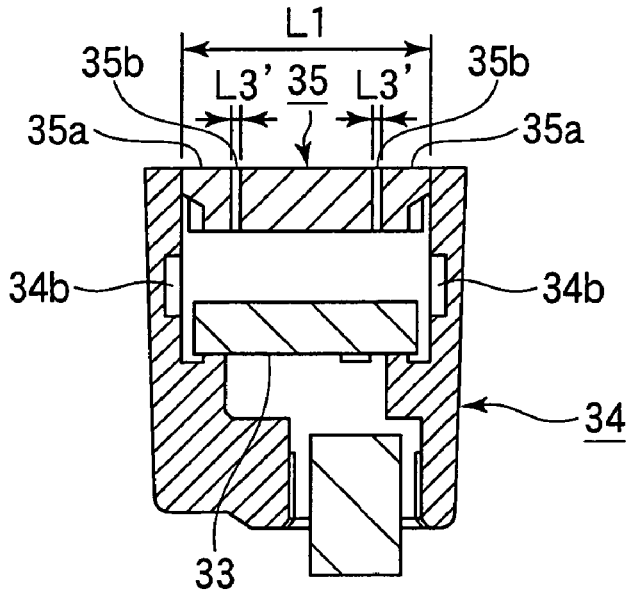
FIG. 10 is a second view for illustrating the mounting process of the base according to the first embodiment of the present invention.
Figure 11:
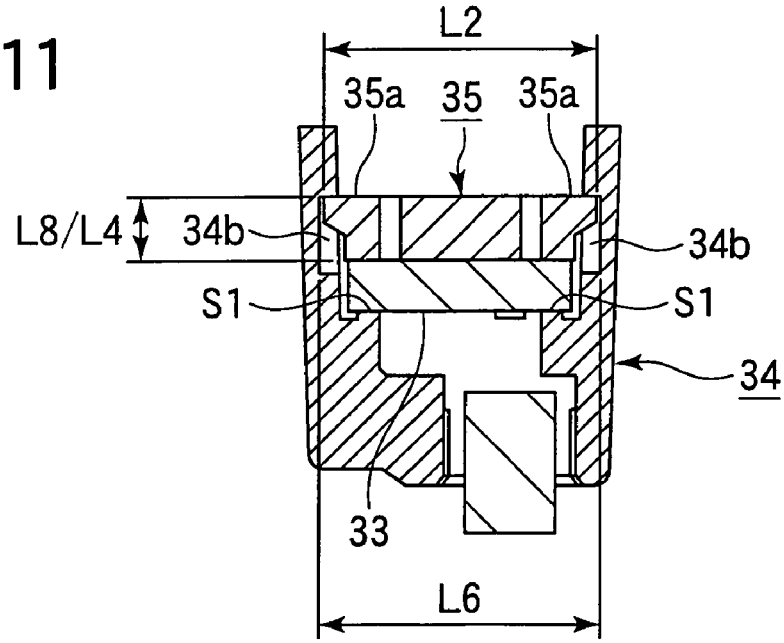
FIG. 11 is a third view for illustrating the mounting process of the base according to the first embodiment of the present invention.

FIG. 9 is a first view for illustrating the mounting process of the base according to the first embodiment of the present invention. FIG. 10 is a second view for illustrating the mounting process of the base according to the first embodiment of the present invention. FIG. 11 is a third view for illustrating the mounting process of the base according to the first embodiment of the present invention.

As shown in FIG. 9, when the base 35 is to be inserted into the area R3 of the lens array holder 34, the chamfered portions 35*c* of the protrusions 35*a* are brought into contact with edge portions 34*a* of upper ends of the inner walls of the lens array holder 34. When the base 35 is pushed downwardly into the lens array holder 34, the edge portions 34*a* are guided by the chamfered portions 35*c* of the protrusions 35*a*, and the bridge portions 35*d* are deflected resisting resilient forces thereof so that the protrusions 35*a* are shifted inwardly.

The distance L2 between the tips of the protrusions 35*a* varies from L2 (FIG. 6) to L2' (FIG. 7) which is slightly smaller than the distance L1 between the inner walls of the lens array holder 34. The base 35 can be moved downwardly while keeping the tips of the protrusions 35*a* in contact with the inner walls of the lens array holder 34 as shown in FIG. 10. In this state, the width of each slit 35*b* is reduced from L3 (FIG. 9) to L3' (FIG. 10).

As shown in FIG. 11, when the base 35 contacts the substrate 33, the protrusions 35*a* move into the grooves 34*b* due to the resilient force of the bridge portions 35*d*. The distance L2' (FIG. 7) between the tips of the protrusions 35*a* returns to L2. Since the protrusions 35*a* engage the grooves 34*b*, the base 35 is not dropped out of the lens array holder 34.

As described above, according to the first embodiment of the present invention, when the base 35 is mounted to the lens holder 34, the protrusions 35*a* move into the grooves 34*b* due to the resilient force of the bridge portions 35*d* so that the protrusions 35*a* engage the grooves 34*b*. Therefore, it is not necessary to use clamps (see FIGS. 17 and 18) protruding outwardly from the lens array holder 34. Accordingly, the size of the LED head can be reduced.

Further, the substrate 33 is directly forced against the contact surfaces S1 (FIG. 11) by the base 35, and therefore the operation for mounting the substrate 33 to the lens array holder 34 can be simplified.

Second Embodiment

In the above described first embodiment, it is necessary that the distance L11 from the surface of the LED array chip 31 to the incident end surface of the rod lens array 32 is the same as the distance L12 from the emitting end surface of the rod lens array 32 to the surface of the photosensitive drum 13Bk, in order to correctly focus the light on the surface of the photosensitive drum 13Bk. Since the distance L12 can be adjusted by the eccentric cam mechanism 42 and 43 as described above, it is preferable that the distance L11 is kept constant.

In this regard, if there are variations in the positions of the upper ends of the grooves 34*b* of the lens array holder 34, the thickness L4 of the base 35 or the like, it is difficult to stably force the substrate 33 against the contact surfaces S1.

Therefore, the second embodiment of the present invention is intended to stably force the substrate 33 against the contact surfaces S1 even when there are variations in dimensions as described above.

Components that are the same as those of the first embodiment are assigned the same reference numerals. Regarding advantages obtained by configurations which are the same as those of the first embodiment, the descriptions of the advantages in the first embodiment are herein incorporated.

Figure 12A:
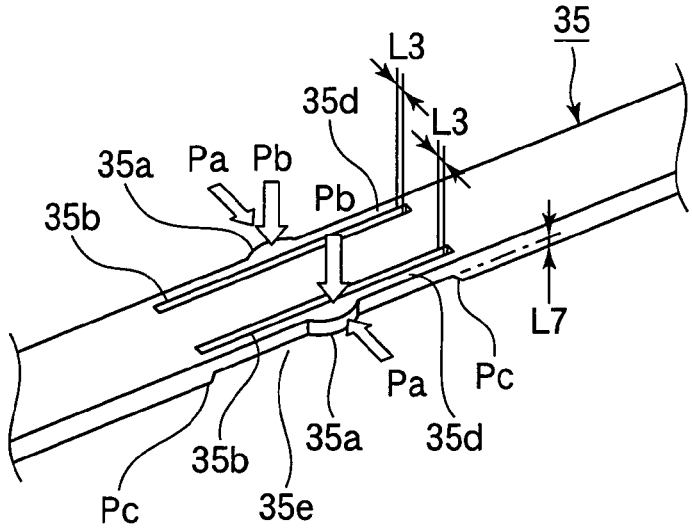
FIG. 12A is a perspective view showing part of a base according to the second embodiment of the present invention.
Figure 12B:
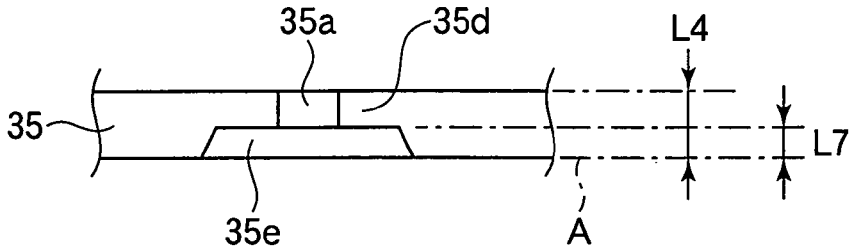
FIG. 12B is a side view showing part of the base shown in FIG. 12A.
Figure 13:
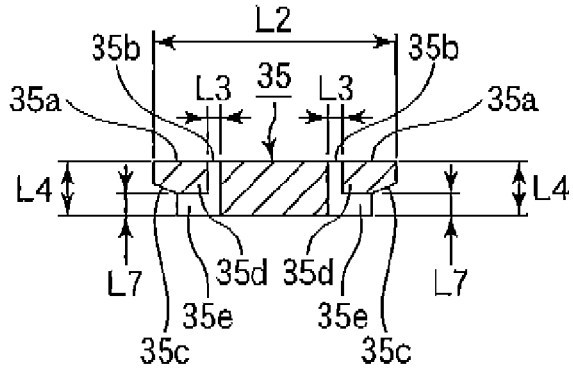
FIG. 13 is a cross sectional view showing the base according to the second embodiment of the present invention.
Figure 14:
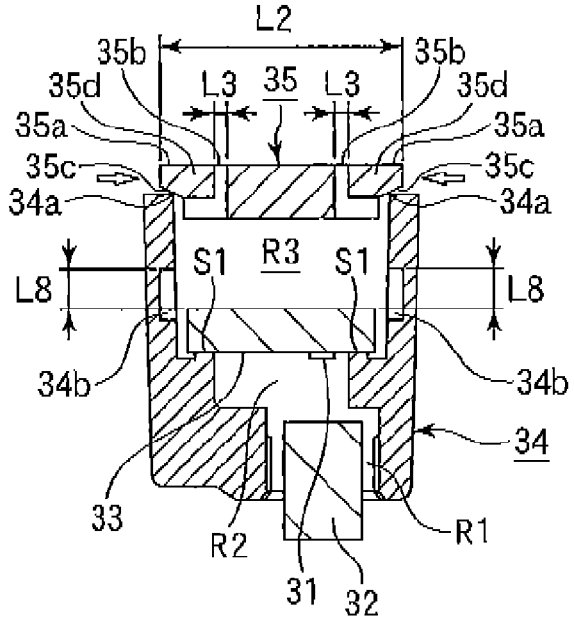
FIG. 14 is a first view for illustrating a mounting process of the base according to the second embodiment of the present invention.
Figure 15:
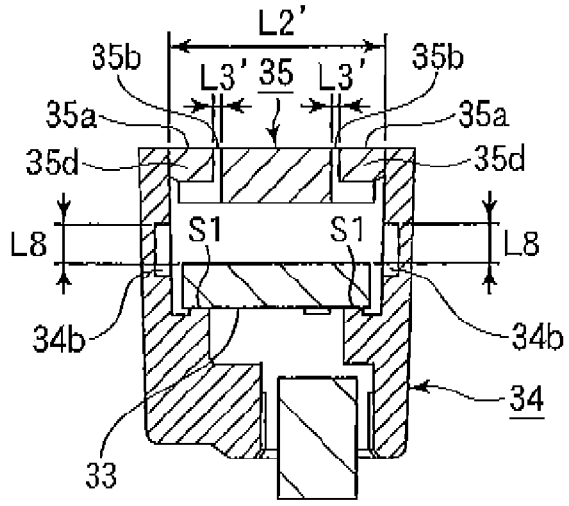
FIG. 15 is a second view for illustrating the mounting process of the base according to the second embodiment of the present invention.
Figure 16:
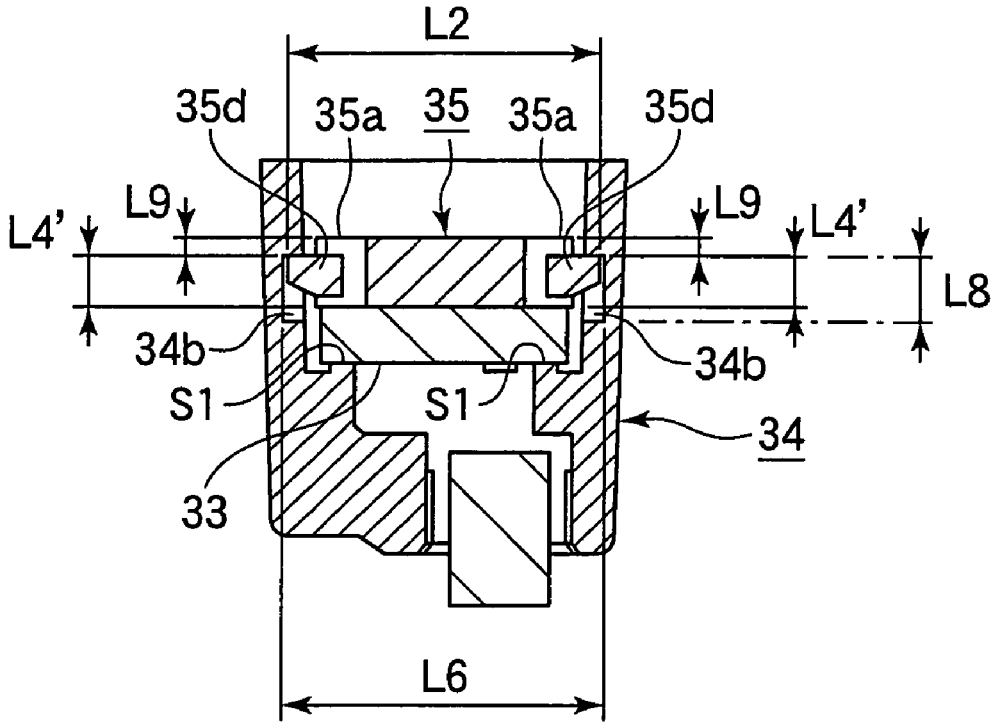
FIG. 16 is a third view for illustrating the mounting process of the base according to the second embodiment of the present invention.

FIG. 12A is a perspective view showing part of a base according to the second embodiment of the present invention. FIG. 12B is a side view showing part of the base shown in FIG. 12A. FIG. 13 is a cross sectional view showing the base according to the second embodiment of the present invention. FIG. 14 is a first view for illustrating the mounting process of the base according to the second embodiment of the present invention. FIG. 15 is a second view for illustrating the mounting process of the base according to the second embodiment of the present invention. FIG. 16 is a third view for illustrating the mounting process of the base according to the second embodiment of the present invention.

As shown in FIG. 12A, a plurality of protrusions 35*a* (i.e., forcing members) are formed along both longer edges of the base 35 (i.e., ends in the widthwise direction of the base 35), and are disposed on a plurality of positions in the longitudinal direction of the base 35. Each protrusion 35*a* has a predetermined shape, and more specifically has an arc-shaped outer surface. The protrusions 35*a* protrude outwardly from both longer edges of the base 35. The protrusions 35*a* have chamfered portions 35*c* (i.e., guide portions) at the lower sides thereof as shown in FIG. 13. Slits 35*b* (each having the width. L3) are formed on the base 35 and are disposed on the inner sides with respect to the protrusions 35*a*. The slits 35*b* have predetermined lengths so as to extend on both sides of the protrusions 35*a* in the longitudinal direction of the base 35. A bridge portion 35*d* (i.e., a forcing portion or a deflectable portion) is formed between each slit 35*b* and the longer edge of the base 35. The bridge portions 35*b* have predetermined lengths so as to extend on both sides of the protrusions 35*a* in the longitudinal direction of the base 35. When forces are exerted on the protrusions 35*a* from both sides as shown by arrows Pa in FIG. 12A, the bridge portions 35*d* are deflected inwardly in the widthwise direction of the base 35, and cause the widths L3 of the slits 35*b* to be reduced so that both inner walls of each slit 35*b* contact each other.

As shown in FIG. 14, the distance L2 between tips of protrusions 35*a* opposing each other in the widthwise direction of the base 35 is set to be larger than the distance L1 between the inner walls of the lens array holder 34 as follows:

$$L2>L1.$$

Further, as shown in FIG. 15, the distance L2' between the tips of the protrusions 35*a* (opposing each other in the widthwise direction of the base 35) when the bridge portions 35*d* are deflected inwardly by predetermined amount is set to be slightly smaller than the above described distance L1.

As shown in FIGS. 12A and 12B, in the second embodiment, cutaway portions 35*e* are formed below the respective bridge portions 35*d*. The cutaway portions 35*e* (both ends thereof are defined by points Pc in FIG. 12A) have lengths which are substantially the same as the bridge portions 35*d* and the slits 35*b*. A distance L7 represents a distance between the bottom surface of the bridge portion 35*d* and the bottom surface of the base 35 as shown in FIG. 12B. When forces are exerted on the protrusions 35*a* from upward as shown by arrows Pb in FIG. 12A, the bridge portions 35*d* are deflected downwardly, and the distance L7 is reduced. In other words, the bottom surface of the bridge portion 35*d* shifts closer to a surface A (FIG. 12B) aligned with the bottom surface of the base 35.

In order to mount the base 35 to the lens array holder 34, grooves 34*b* (i.e., second engaging portions) are formed on the inner walls of the lens array holder 34. The grooves 34*b* are disposed on positions corresponding to the respective positions of the protrusions 35*a* of the base 35. Each groove 34*b* has a shape corresponding to the protrusion 35*a*, more specifically has an arc-shaped inner surface in this embodiment. The grooves 34*b* are formed to be slightly larger than the protrusions 34*a* (see FIG. 8). The distance L6 (FIG. 16) between bottoms of the grooves 34*b* opposing each other in the widthwise direction of the base 35 is larger than the above described distance L2 as follows:

$$L6>L2.$$

In this regard, contact surfaces S1 of the lens array holder 34 are formed below the grooves 34*b* as shown in FIG. 14. When the substrate 33 is placed on the contact surfaces S1, an upper surface of the substrate 33 is at a higher position than the lower ends of the grooves 34. In a state where the substrate 33 is placed on the contact surfaces S1, a distance L8 from the upper surface (i.e., a first surface) of the substrate 33 to the upper end (i.e., a first surface) of the grooves 34*b* is slightly smaller than a thickness L4 of the base 35 as follows:

$$L4>L8.$$

Next, the mounting operation of the base 35 will be described.

As shown in FIG. 14, when the base 35 is to be inserted into the area R3 of the lens array holder 34, the chamfered portions 35*c* of the protrusions 35*a* are brought into contact with edge portions 34*a* of upper ends of the inner walls of the lens array holder 34. When the base 35 is pushed downwardly into the lens array holder 34, the edge portions 34*a* are guided by the chamfered portions 35*c* of the protrusions 35*a*, and the bridge portions 35*d* are deflected resisting resilient forces thereof so that the protrusions 35*a* are shifted inwardly.

The distance L2 between the tips of the protrusions 35*a* varies from L2 (FIG. 13) to L2' (FIG. 15) which is slightly smaller than L1 between the inner walls of the lens array holder 34. The base 35 can be moved downwardly while keeping the tips of the protrusions 35*a* in contact with the inner walls of the lens array holder 34 as shown in FIG. 15. In this state, the width of each slit 35*b* is reduced from L3 (FIG. 13) to L3' (FIG. 15).

Further, as shown in FIG. 16, when the base 35 contacts the substrate 33, a further downward movement of the base 35 is stopped by the substrate 33. In this regard, when the bridge portions 35*d* are pushed downwardly, the bridge portions 35*d* are deflected downwardly, and the protrusions 35*a* move into the grooves 34*b* due to the resilient forces of the bridge portions 35*d*. The distance L2' (FIG. 15) between the tips of the protrusions 35*a* returns to L2 (FIG. 16). Since the protrusions 35*a* engage the grooves 34*b*, the base 35 is not dropped out of the lens array holder 34.

In this state, the deflecting amount L9 of each bridge portion 35*d*, the distance L4' from the bottom surface (i.e., a forcing surface) of the base 35 to the upper surface of the bridge portions 35*d* and the thickness L4 (FIG. 15) of the base 35 satisfy the following relationship with the above described distances L4 and L8:

$$L4'=L4-L9<L8$$

In this case, the bridge portions 35*d* are going to return to their original shapes due to resilient forces, and therefore the base 35 continuously generates a constant force to force the substrate 33 against the contact surfaces S1.

As described above, according to the second embodiment of the present invention, when the base 35 is mounted into the lens holder 34, the protrusions 35*a* engage the grooves 34*b* by causing the bridge portions 35*d* to be deflected downwardly. Therefore, in addition to the advantages of the first embodiment, it becomes possible to stably force the substrate 33 against the contact surfaces S1.

Comparative Example

Figure 17:
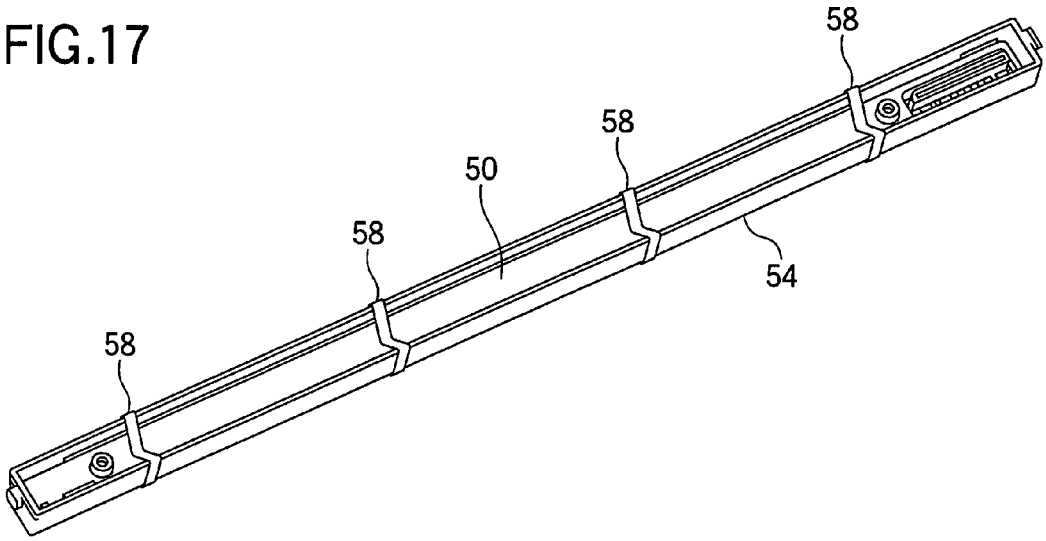
FIG. 17 is a perspective view showing an LED head according to Comparative Example.
Figure 18:
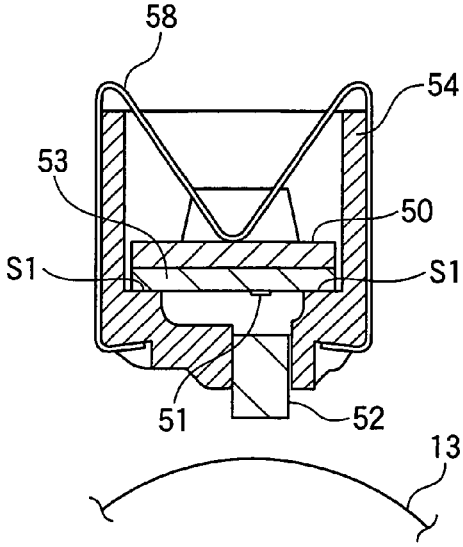
FIG. 18 is a sectional view showing the LED head according to Comparative Example.

FIG. 17 is a perspective view showing an LED head according to the comparative example compared with the above described embodiments of the present invention. FIG. 18 is a cross sectional view showing the LED head according to the comparative example shown in FIG. 17.

The LED head of the comparative example includes an LED array chip 51 that emits light and a rod lens array 52 that focuses the light on the surface of a photosensitive drum 13. The rod lens array 52 is held by a lens array holder 54. The LED array chip 51 is formed on a substrate 53 mounted in the lens array holder 54.

The substrate 53 is placed on contact surfaces S1 formed inside the lens array holder 54. Further, a base made of metal is placed on the substrate 53. A plurality of clamps 58 are attached to the lens array holder 54 for forcing the substrate 53 against the contact surfaces S1 via the base 50.

In the configuration shown in FIGS. 17 and 18, the clamps 58 protrude outwardly from the lens array holder 54, and therefore the size of the LED head becomes large. Further, it is necessary to force the substrate 33 against the contact surfaces S1 using the clamps 58, and therefore the operation for mounting the substrate 33 to the lens array holder 34 becomes complicated.

In contrast, according to the first and second embodiments of the present invention (FIGS. 1 through 16), the base 35 can be mounted to the lens array holder 34 without using clamps, and therefore the size of the LED head can be reduced. Further, the substrate 33 can be forced against the contact surface S1 by the base 35, and therefore the operation for mounting the substrate 33 to the lens array holder 34 can be simplified.

The first and second embodiments have been described as being employed in the printer as an example of an image forming apparatus. It is also possible to apply the present invention to a copier, a facsimile machine, a complex machine or the like.

While the preferred embodiments of the present invention have been illustrated in detail, it should be apparent that modifications and improvements may be made to the invention without departing from the spirit and scope of the invention as described in the following claims.

What is claimed is:

1. An exposure device comprising:

a substrate having first and second surfaces opposite to each other;

a light emitting element array on said first surface;

a focusing lens facing said first surface and focusing light emitted by said light emitting element array;

a supporting member supporting said focusing lens; and a base contacting said second surface, said base including a forcing portion that generates a force toward a surface where said base and said substrate contact each other; and wherein an end of said forcing portion is connected to said base, and a deflection of said forcing portion generates said force.

2. The exposure device according to claim 1, wherein said forcing portion is provided at a region of said base other than a region facing said substrate.

3. The exposure device according to claim 1, wherein said forcing portion is provided at regions of said base corresponding to mutually facing edges of said substrate.

4. The exposure device according to claim 1, wherein said forcing portion protrudes from said base.

5. The exposure device according to claim 4, wherein said forcing portion faces said supporting member.

6. The exposure device according to claim 4, wherein said forcing portion protrudes toward said supporting member.

7. The exposure device according to claim 1, wherein said substrate is held between a surface of said base facing said substrate and a step portion of said supporting member.

8. An image forming apparatus comprising an exposure device according to claim 1.

9. The exposure device according to claim 1, wherein said forcing portion is deflected in a direction substantially perpendicular to a surface of said base facing said substrate.

10. The exposure device according to claim 1, wherein said forcing portion is integrally formed with said base.

11. An exposure device comprising:

a substrate having first and second surfaces opposite to each other;

a light emitting element array on said first surface;

a focusing lens facing said first surface and focusing light emitted by said light emitting element array;

a supporting member supporting said focusing lens; and a base contacting said second surface of said substrate, said base including a forcing portion that generates a force that is exerted on said substrate; and wherein an end of said forcing portion is connected to said base, and a deflection of said forcing portion generates said force.

12. The exposure device according to claim 11, wherein said forcing portion forces said base to maintain said light emitting element array and said focusing lens at a predetermined distance apart.

13. The exposure device according to claim 11, said forcing portion is provided at a region of said base other than a region facing said substrate.

14. The exposure device according to claim 11, wherein said forcing portion is provided at regions of said base corresponding to mutually facing edges of said substrate.

15. The exposure device according to claim 11, wherein said forcing portion protrudes from said base.

16. The exposure device according to claim 15, wherein said forcing portion faces said supporting member.

17. The exposure device according to claim 15, wherein said forcing portion protrudes toward said supporting member.

18. The exposure device according to claim 11, wherein said substrate is held between a surface of said base facing said substrate and a step portion of said supporting member.

19. An image forming apparatus comprising an exposure device according to claim 11.

20. The exposure device according to claim 11, wherein said forcing portion is deflected in a direction substantially perpendicular to a surface of said base facing said substrate.

21. The exposure device according to claim 11, wherein said forcing portion is integrally formed with said base.

* * * * *